United States Patent [19]

Taylor

[11] Patent Number: 4,867,054

[45] Date of Patent: Sep. 19, 1989

[54] CALIPER CONTROL SYSTEM

[75] Inventor: Bruce F. Taylor, Auburn, Mass.

[73] Assignee: Thermo Electron Web Systems, Inc., Auburn, Mass.

[21] Appl. No.: 206,970

[22] Filed: Jun. 9, 1988

Related U.S. Application Data

[63] Continuation of Ser. No. 148,101, Jan. 26, 1988, abandoned, which is a continuation of Ser. No. 834,953, Feb. 28, 1986, abandoned.

[51] Int. Cl.[4] ..... B30B 15/34

[52] U.S. Cl. ..... 100/93 RP; 100/162 B

[58] Field of Search ..... 100/38, 47, 93 RP, 162 B

[56] References Cited

U.S. PATENT DOCUMENTS

| | | | |
|---|---|---|---|
| 737,571 | 9/1903 | Bray | 100/93 RP |
| 1,739,572 | 12/1929 | Bidwell | 100/93 RP |
| 2,993,432 | 7/1961 | Youngchild | 100/93 RP |
| 3,177,799 | 4/1965 | Justus et al. | 100/93 RP |
| 3,190,212 | 6/1965 | Moore | 100/38 |
| 3,266,561 | 8/1966 | Beachler et al. | 100/93 RP X |
| 3,394,736 | 7/1968 | Pearson | 165/179 |
| 4,114,528 | 9/1978 | Walker | 100/47 |
| 4,323,115 | 4/1982 | Stafford et al. | 165/175 X |
| 4,573,402 | 3/1986 | Sharma et al. | 100/38 |
| 4,605,366 | 8/1986 | Lehmann et al. | 100/93 RP X |
| 4,653,396 | 3/1987 | Wennerberg | 100/38 |
| 4,768,433 | 9/1988 | Boissevain | 100/93 RP |

FOREIGN PATENT DOCUMENTS

| | | | |
|---|---|---|---|
| 927641 | 6/1973 | Canada | 100/93 RP |

*Primary Examiner*—Wm. Carter Reynolds
*Attorney, Agent, or Firm*—Lorusso & Loud

[57] ABSTRACT

A caliper control system for controlling the thickness and sheet quality of paper passing between calender rolls of a calender stack includes a distribution chamber which houses a supply of heat transfer fluid. A series of nozzles extends across the width of the unit in the cross machine direction, and each of these nozzles are selectively actuable. An actuating means, which may be a piston connected to a solenoid, opens and closes an opening in the wall between the distribution chamber and the nozzle for each nozzle of the unit. In a preferred embodiment, the caliper control system includes two such units. One of these units will supply hot air to the roll surface, and the roll to which the hot air is applied to an unheated roll. The second unit will supply cold air to a heated roll. Each of the nozzles is covered with a plate which includes a large number of apertures for expelling the heat-transfer fluid from the nozzle. The travel of the heat-transfer fluid is such that an impingement flow is created through the apertures. The heat transfer fluid is heated or cooled by a heat exchanger which includes a number of internally finned tubes over which a steam or cold water flow is applied. The air forced through the tubes by a fan is then either heated or cooled.

11 Claims, 6 Drawing Sheets

CALIPER CONTROL SYSTEM

This is continuation of co-pending application Ser. No. 148,101, filed Jan. 26, 1988, now abandoned, which is a continuation of co-pending application Ser. No. 834,953, filed Feb. 28, 1986, now abandoned.

BACKGROUND OF THE INVENTION

This invention relates to papermaking and more particularly to a system for controlling the thickness and sheet quality of paper passing through calendar rolls.

One of the final stages in the papermaking operation is a calendering operation where a dry web of paper is passed through a narrow nip formed between two calender rolls. The calendering operation takes place downstream from the location where the web is formed, and it is performed by a calender stack consisting of two or more contacting, rotating metal rolls. The web is threaded through the rolls and exposed to the contact pressure generated by the contact of adjacent rolls. The contact pressure alters the web thickness and surface qualities, and the alteration of these web qualities can be regulated by a controlled variation of the roll-to-roll contact pressure. The interaction of the rolls and the web result in compacting the web and changing the caliper, density and surface and optical characteristics of the web by pressure, friction, temperature and other physical condition changes. The uniformity of the compacting action, or calendering intensity, depends on the uniformity of the nip pressure, which depends on the uniformity of the contact between the adjacent rolls, and which in turn depends on the local roll diameter (the diameter of a portion of the roll).

Provided that the rolls are made of materials that respond to changes in temperature, the roll-to-roll contact pressure can be altered by causing changes in temperature along the roll to thereby effect a controlled variation of the local roll diameter. The local roll diameter can be altered by either controlled local heating or local cooling of the roll which results in an expansion or contraction of the local roll diameter respectively.

There are several known methods for altering the local roll diameter by local heating or cooling. Friction pads have been pressed against a local area of the roll to raise the temperature and thereby increase the local roll diameter. Such pads, however, tend to wear the roll surface and thus defeat the purpose for which they were intended.

Single nozzle air-jets have also been employed for many years (typically utilizing compressed or low pressure air) to change the temperature and thereby the local roll diameter in the region of air application. The magnitude of correction and response achieved through the use of such single-jet "air showers" is low because of the low effective heat-transfer rate over the desired surface area to be controlled. This low effective heat-transfer rate results from the fact that the high jet-velocity originating from the nozzle strikes the roll surface over a small localized region of the roll. The velocity-vector following impact is then roughly parallel to the roll surface, and exhibits a relatively low heat transfer rate when compared to the original impingement-flow heat transfer rate. The effective heat-transfer rate over an arbitrary portion of the roll surface larger than the original area of jet impact is then significantly lower than desired. In addition, due to the curvature of the roll and the rebounding of jet-air after impact, the entire area of the roll which is to have its diameter changed does not come into contact with the heat-transfer fluid. As a result, the control of the local roll diameter through the directing of a single cross-machine row of jets of hot or cold air against the local area of the roll is, therefore, not entirely adequate (especially when the high cost of energy and the considerable amounts of energy required to cause an acceptable change in the local roll diameter are considered).

Some systems have employed the use of a "shroud" through which the nozzle air projects to keep the "spent-flow" in contact with the roll over a significantly larger portion of the area to be controlled. While systems utilizing such shrouds are more efficient than single-nozzle air-jet systems, the effective heat-transfer rate of systems utilizing a shroud is still hampered by the relatively low heat transfer rates coincident with parallel-flow as is observed over the control area contacted by the spent-flow.

A tremendous amount of energy can be wasted in heating or cooling the rolls because with typical system efficiencies, the changing of the roll surface temperature a chosen number of degrees requires application of a fluid of a temperature considerably lower or greater than the desired roll surface temperature, and the energy utilized to effect the temperature change is lost once the fluid is applied to the roll. It is therefore important that the percentage of the energy consumed in the creation of the temperature difference, which is transferred to or from the roll surface, is minimized.

Another limitation of known caliper control equipment is that the devices used for heating or cooling the roll should be of a size capable of being placed adjacent a roll while at the same time leaving enough space for other equipment to be positioned in a working relationship with respect to adjacent rolls. With reference to the equipment commonly used to initially heat or cool the air, the heat-transfer rates (as related to the convective heat-transfer coeffecients of the equipment) offered by conventional steam-to-air or water-to-air heat exchangers, are prohibitively low, so as to render the size of such exchangers unacceptably large for their installation in the immediate region of the calender stack. When reducing equipment size, however, it is important to insure that the absolute magnitude of heat-transfer to or from the roll is satisfactory and therefore not greatly reduced.

Most existing caliper-control systems employ one of the four following control methods:

(1) Only heating of the roll is performed, as with hot air or induction heating.

(2) Only cooling of the roll is performed with cold air.

(3) Heating and cooling of the roll is performed with one unit, the nozzles of which pass hot or cold air as desired from one of two supply chambers which are housed together within the same apparatus.

(4) Heating and cooling of the roll is performed by applying a uniform air-flow against the roll, across the full roll width, the temperature of which is positionally controlled from the ambient supply temperature up to a suitable maximum.

Each of the above-described methods possess certain disadvantages. When a caliper control device can only heat a roll, only expansion of the roll and the related further sheet compression can be executed directly. To profile a sheet that exhibits both thin and thick profile inconsistensies across the machine, it is necessary to establish a roughly 50% output baseline for the system. In other words, for those sheet positions where the thickness requires no correction, the actuators or nozzles would operate at approximately 50% power output or heat-transfer rate. For those sheet positions that are too thick, requiring additional compression, the nozzles would operate anywhere from approximately 50% to 100% output, as required. For those positions that are too thin, requiring that the compression be disminished, the nozzles would operate anywhere from approximately 50% down to 0%, as required.

In the heating mode (50 to 100% output) the sheet response is relatively rapid due to the "forced" heat-transfer to the roll provided by the actuators or nozzles. In the cooling mode, however, (0 to 50% output) the time response of the system is limited to the speed at which the related roll position can expel its thermal energy through such phenomena as natural convection, radiation, etc. The cooling-mode response is obviously significantly slower than the heating-mode response.

As "heating only" caliper control systems are typically part of a closed-loop control systems, including an on-line sheet-thickness scanner and a computer station which analyzes the sensed values and requests action by the caliper-control system accordingly, the response of the differential control loop is only as rapid as the slower of the two heat-transfer modes, which severely hampers the settling-time of the control effort. In addition, because the system base-line or "zero-point" is approximately 50% output, in the presence of a majority of sheet positions which require little or no control, the average operating power consumption is unnecessarily high.

In "cooling only" caliper control systems, only contraction of the roll and related reduction of the sheet compression can be executed directly. The disadvantages of this approach are identical to those of the heating only system described above, but opposite in nature.

In heating and cooling caliper control systems, expansion and contraction of the roll can be effected directly. These systems may utilize either of two types of in-line nozzles. One known nozzle includes two individual nozzles - one for imparting cold air from a cold air supply plenum and another for imparting hot air from the hot air supply plenum. The other known type of nozzle comprises a single nozzle which selectively imparts air from either of the two plenums, as required. With both types of nozzles, conduction from one plenum to the other through the body of the common housing decreases the effective temperature gradient available from both supplies. In addition, with the second type of nozzle, a nozzle previously imparting hot air exhibits a substantial thermal time-lag when requested to revert to cooling operation. The same problem is faced in the opposite situation of a nozzle operating in the cooling-mode being requested to change to the heating-mode.

Systems which apply a constant air flow of variable temperature typically utilize compact electrical resistance heaters, located individually in each nozzle-outlet region, to positionally control the nozzle exit temperature. Such resistance heaters exhibit a thermal time-lag when requested to revert from high to low temperature operation, or visa-versa, the effect of which is to hamper the response and settling time of the profiling effort.

A steel roll (as is commonly in use on a calender stack) exhibits, when locally cooled or heated, a tendency to expand or contract less than would be the case for a uniformly heated or cooled body because of the existence of built-up thermal stresses which oppose the radius change. In addition to the undesirable, but unavoidable, radial temperature gradients which limit the radial change in response to a surface temperature change, axial surface temperature gradients, which result when one region of the roll surface is heated or cooled more than an adjacent region, also reduce the effective radial change at the desired location. Often, when a thin and thick sheet condition are close in axial proximity, heating and cooling must be executed in nearly adjacent surface locations, which reduces the effective radius change capability of each action because of the resultant axial surface temperature gradients.

Present caliper-control systems typically utilize large quantities of electrical energy for the purpose of imparting heat to the roll. Typical rates of consumption of 5 to 10 kw per cross-machine foot are common. A system employing three inch spaced nozzles on a three-hundred inch machine would thus require 100 separate power circuits accounting for 1.25 to 2.5 kw each. In addition to the fact that such electrical circuitry may be considered complex, electrical energy in some regions of the world is prohibitively expensive.

Systems which employ heated or cooled air often preheat or precool the air at a distance from the caliper-control unit (usually in close proximity to the air supply fan). The conduits which convey the air to the caliper-control unit must therefore be insulated to prevent undesirable heat-losses or gains, to or from the air, between the heating and cooling exchangers and the caliper-control unit. The initial costs, as well as the installation costs, of such insulation may be substantial.

Finally, the accurate and repeatable control of heat-transfer rates achieved through the use of air nozzle type systems is difficult to accomplish for a number of reasons. Often, the heat-transfer rate is varied by altering of the volumetric flow-rate. Problems, however, result because the flow-rate is typically not linearly-proportional to the travel of the actuator component used to modulate the flow and because the heat-transfer rate is typically not linearly-proportional to the air flow rate.

It is therefore a principal object of the invention to provide a system and method for heating and cooling a desired local area of one or more calender rolls in an effecient manner, using a minimal amount of readily available low-cost energy, in a compact form, with accurate, repeatable, and linearly-adjustable control.

Another object of the present invention is to provide a system and method for heating or cooling only one local area of a roll by applying a uniform flow of air to only that one local area of the roll.

A further object of the present invention is to provide a system and method for heating or cooling a selected local area of a roll which maintains the high heat-transfer rates available from impingement flow over the full area of the surface intended to be controlled.

Another object of the present invention is to provide a system and method for heating or cooling a selected local area of a roll which exhibits an impingement flow pattern which optimizes the heat-transfer to energy-consumed ratio exhibited by the apparatus.

Yet another object of the present invention is to provide a system and method for varying local roll diameter in which the effectiveness of the heating and cooling modes, when executed in close cross-machine proximity to one another, can be improved by applying the two heat-transfer modes to different calender rolls, thereby reducing the resultant axial temperature gradients with respect to any one roll.

Still another object of the present invention is to provide a system and method for varying the local diameter of a calender roll which provides for the "forced" heating and cooling of separate rolls, the roll temperatures being opposite in sense to the temperatures of the supply air utilized to vary the diameter.

A still further object of the present invention is to provide a system and method for varying the local diameter of a roll which can achieve high enough heat-transfer rates to allow for the use of lower temperature heating-mode supply air, which in turn enables the use of steam as the energy source, without detrimentally limiting the absolute nozzle-to-roll heat-transfer rate.

It is another object of the present invention to provide a system and method for varying the local diameter of a roll which heats or cools the air applied to the roll at the calender stack itself so as to eliminate the need for conduit insulation, and thereby minimize the likelihood of undesirable heat-losses or gains to or from the hot and cold air prior to its application to the process.

An even further object of the present invention is to provide a heat-exchanger whose design and size enables the exchanger to be installed in the immediate region of the calender stack.

SUMMARY OF THE INVENTION

The improved caliper control apparatus of the present invention utilizes nozzles, each of which is constructed of an array of round holes in a flat plate. The flat plate surface of the nozzle is bent to conform to the diameter of the roll to be heated or cooled. The apparatus includes a cross-machine plenum which distributes air to the nozzles. Solenoid driven pneumatic cylinders allow the passage of air from the plenum to a corresponding nozzle chamber which is isolated from adjacent nozzle chambers, by baffle plates, and whose outside surface is formed by the perforated flat plates. The air is expelled through the array of holes into contact with the roll for the purpose of heating or cooling the roll.

In a preferred embodiment, one cross-machine apparatus applying cold air to the roll is installed adjacent one roll. Another apparatus supplying hot air is installed adjacent a second roll. Also, in a preferred embodiment of the system of the present invention, the apparatus supplying cool air cools a heated roll, and the apparatus applying hot air supplies the hot air to an unheated roll.

Air is provided to the system by a high pressure fan, typically located in a basement area below the paper machine. Air is supplied at an air pressure of approximately 30 inches of water gauge, and is conveyed from the fan to the specific systems by conveying ductwork of suitable design. Just prior to entering the cross-machine manifold that is internal to each apparatus, the air is forced to travel through a compact heat-exchanger wherein it is heated or cooled, as required by the operating mode of the particular apparatus. The hot or cold air then enters the cross-machine apparatus, as previously described, for application to the process. It should be noted that the design of all aspects of the invention is the same for either the heating or cooling embodiments of the invention, and that the use of one apparatus as either a heating or cooling apparatus is dependent only upon the selection of steam or cold water as the heat exchanger fluid, respectively.

These and other objects and features of the present invention will be more fully understood from the following detailed description which should be read in light of the accompanying drawings, in which corresponding reference numerals refer to corresponding parts throughout the several views.

DETAILED DESCRIPTION OF THE PREFERRED EMBODIMENTS

Figure 1:
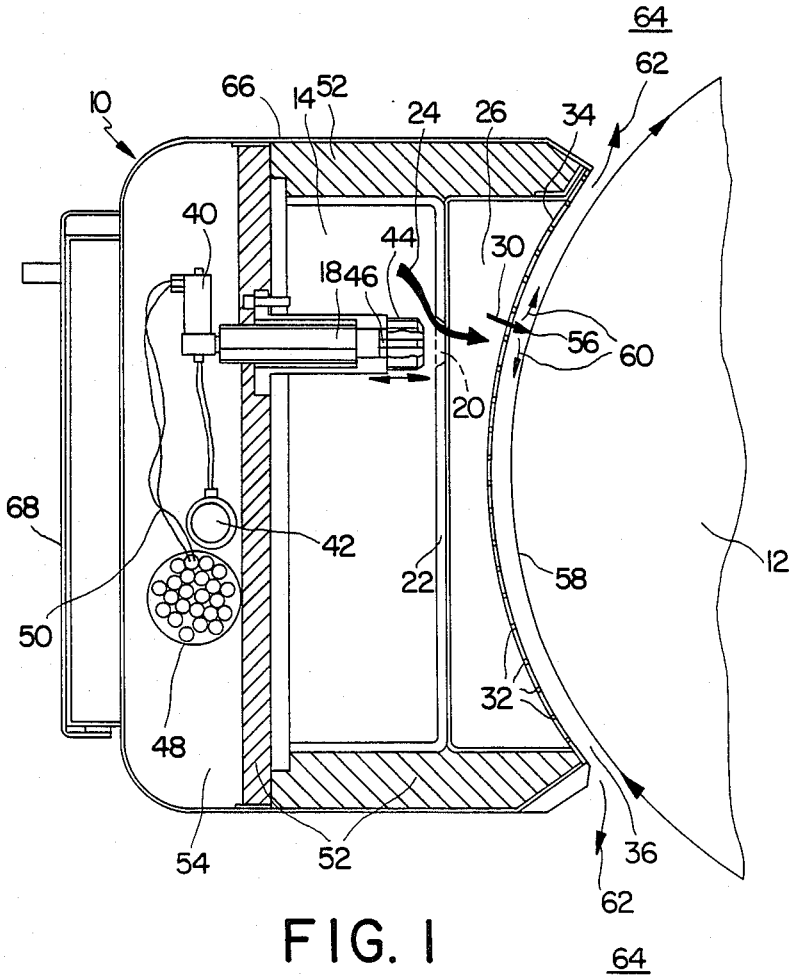
FIG. 1 is a side sectional view of the caliper-control apparatus of the present invention positioned adjacent a calender roll.
Figure 2:
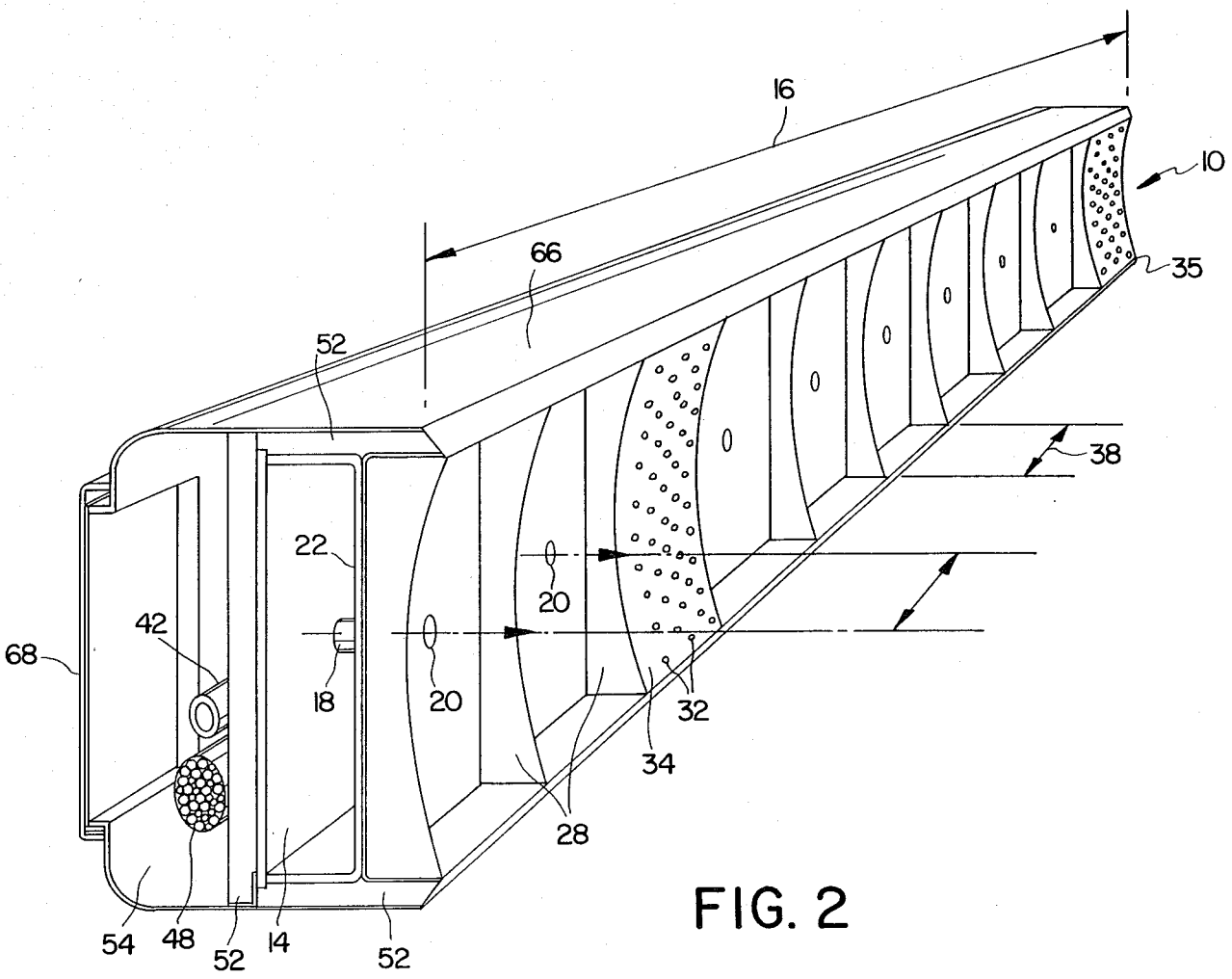
FIG. 2 is a perspective view of the caliper-control apparatus of the invention, partly in section, and with a number of the front nozzle-plates removed for clarity.
Figure 3A:
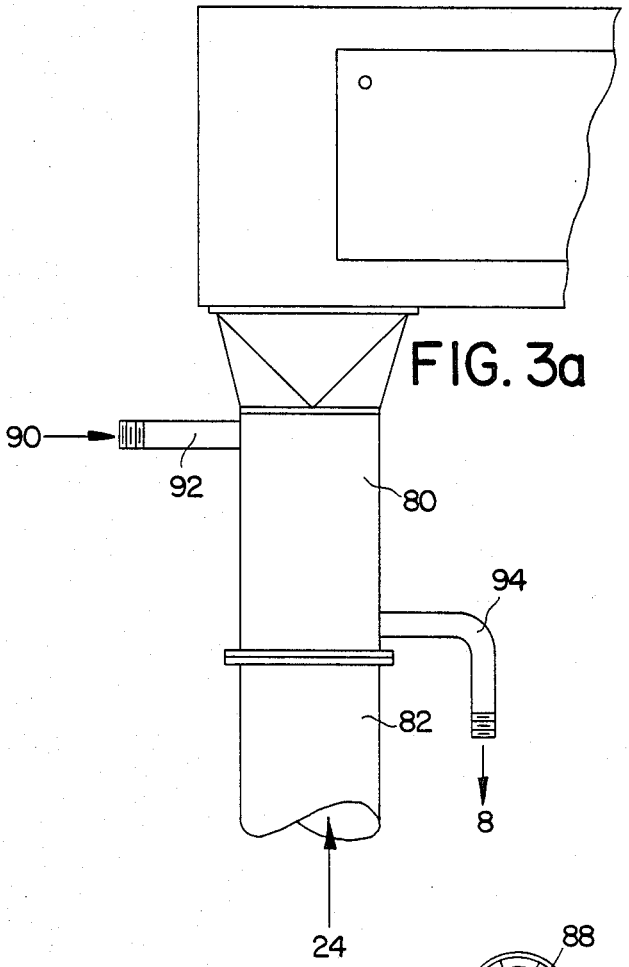
FIG. 3*a* is a plan view, taken along the machine direction of the heat-exchanger apparatus, shown attached to the inlet of the caliper-control apparatus.
Figure 3B:
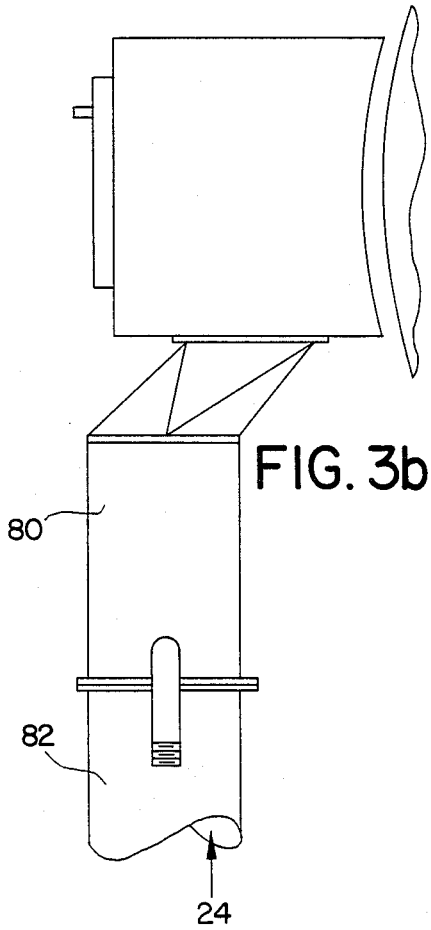
FIG. 3*b* is a plan view taken along the cross machine direction of the heat-exchanger apparatus, shown attached to the inlet of the caliper-control apparatus.
Figure 4:
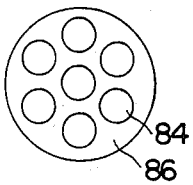
FIG. 4 is a bottom plan view of the inside of the heat-exchanger shown in FIGS. 3*a* and 3*b;*
Figure 5:
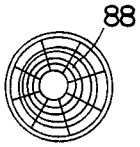
FIG. 5 is a close-up detailed view, in section, of an internally finned tube, an array of which are internal to the heat-exchanger of FIGS. 3*a* and 3*b*, and through which the air-supply flows.
Figure 6:
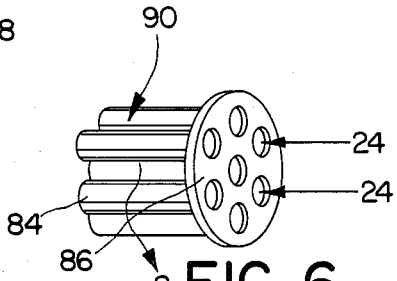
FIG. 6 is a perspective view of the internals of the heat-exchanger of FIGS. 3*a* and 3*b*, showing a partial length of the internally finned tubes of FIG. 5, and one heat-exchanger endplate as shown in FIG. 4.

Referring to FIGS. 1 and 2, a caliper control apparatus 10 of the caliper control system of the present invention is shown adjacent a roll 12, the diameter of which is to be adjusted by the caliper control apparatus 10.

The caliper control apparatus includes a cross-machine distribution plenum 14, which traverses the full width 16 of the apparatus 10. Air enters the plenum 14 after being previously heated or cooled as required by the specific application. Air actuated cylinders 18 positioned co-axially with each nozzle location close or open the respective distribution plenum nozzle orifice 20, located in the outboard wall 22 of the distribution plenum 14. When a pneumatic cylinder 18 is retracted (as shown in FIG. 1), the supply air 24 is permitted to pass into the nozzle chamber 26 of the associated pneumatic cylinder 18 and nozzle orifice 20. Once entering the nozzle chamber 26, the air is prevented from entering adjacent nozzle chambers by baffle-plates 28 which border the two sides of each nozzle chamber 26, effectively creating a series of enclosed, isolated nozzles chambers 26 across the machine 10. From the nozzle chamber 26 the air flow 30 is projected through an array of nozzle holes 32 in the outboard wall 34 of the nozzle chamber 26 into the gap 36 formed between the wall 34 and the roll 12, thereby imparting heat to or removing heat from the roll 12, as required by the specific application. This configuration also insures that the transfer of heat occurs only over that portion 38 of the roll 12 for which the action is designated.

Control of the heat-transfer rate at a selected nozzle position is provided by opening and closing the respective nozzle orifice 20 at a specified rate. A cyclic energizing and de-energizing of the electro-pneumatic solenoid 40 mounted on the rear of the respective pneumatic cylinder 18, carries out the opening and closing of the orifice. When the solenoid 40 is energized, a flow of compressed-air travels from the full cross-machine compressed-air manifold 42, to the pneumatic cylinder 18, thereby extending the valve-poppet 44 attached to the pneumatic cylinder shaft 46 to provide for the opening or closing of the respective nozzle orifice 20. The solenoid 40 is energized and de-energized in response to a specified pulsing electrical signal which is conveyed to each and every solenoid, as desired, through a cross-machine electrical wire conduit 48. The electrical wire conduit 48 contains a pair of wires 50 for each nozzle position and its associated solenoid 40. In preferred embodiments, the on-off pulsing of each solenoid 14 is ultimately controlled by a remote control station, in either a manual manner, or by a computer in response to the overall control criteria of the system.

The air-distribution plenum 14 is surrounded by insulation 52, so as to thermally protect the control chamber 54 and insure that the temperature of the supply air 24 remains suitably close to the temperature at which it initially entered the distribution chamber 14. By maintaining the temperature of the supply air 24 close to the temperature at which it entered the chamber 19, the apparatus 10 insures that the available temperature difference between the nozzle exit air 56 and the roll 12 is maximized. After the nozzle exit air 56 contacts the roll surface 58 and travels with the spent flow stream 60, the nozzle exit air 56 exhausts as an exhaust flow 62 from the region formed between the nozzle surface 34 and the roll 12 to atmosphere 64.

The components of the apparatus described above are enclosed in a sheet metal external cover 66. Access doors 68 are provided at specified spaced locations across the machine to allow for maintenance of the control solenoids 40 and pneumatic cylinders 18.

Referring now to FIGS. 3–6, there is shown a heat-exchanger device 80 which is utilized for heating and cooling the air. Prior to entering the control plenum 14, the supply air 24 passes through the heat-exchanger 80, after having been conveyed to the heat exchanger 80 through a conduit 82 or other suitable conveying means. The heat-exchanger 80 comprises a bank of internally finned tubes 84 welded, at either end of the tubes 84, in a suitable manner to an end-plate 86, which is machined to accept the ends of the tubes 84. The internally finned tubes 84 may be any commercially available tubes which will insure that the internal fin pattern 88 will provide the required internal "air-side" convective heat-transfer coefficient to provide the desired air temperature rise or drop within the heat-exchanger device 80. Upon entering the heat-exchanger apparatus 80, the air 24 is forced to flow through the internally finned tubes 84. A steam or water flow 90 is applied over the outer surface of the finned tubes 84 to facilitate heating or cooling of the air respectively. The steam or water flow 90 is admitted to the heat exchanger apparatus 80 at the upper end of the apparatus 80 through an inlet tube 92, and the steam of water flow 90 exits from the lower end by means of an outlet tube 94. In the case of steam-flow the outlet tube 94 is of course connected to a suitably chosen steam "trap" to insure that only condensate is allowed to exit from the apparatus, thereby guaranteeing full use of the supply steam for the purpose desired.

The use of steam is a simplification of the power supply complex as steam is a readily available high-volume source of energy in a paper mill environment. The possible attractiveness of steam-usage is enhanced by the fact that the heat of condensation of 15 to 35 pounds per hour of steam is approximately equivalent to 5 to 10 kw of electrical power. The use of approximately 15 to 35 pounds per hour of steam, per cross-machine foot, on paper machines of typically 8 to 30 feet widths, is rather negligible in view of the fact that such machines typically consume many tens of thousands of pounds per hour of steam in their dryer sections.

Figure 7:
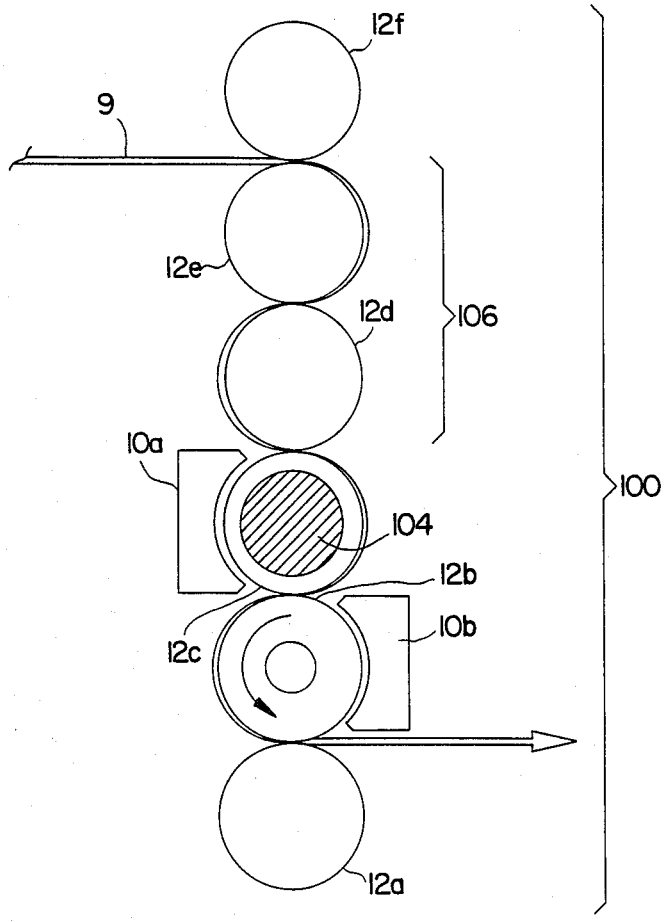
FIG. 7 is a side view of a calender stack, showing the preferred installation of a caliper-control system of the present invention.

Referring now to FIG. 7, a calender stack 100 includes at least two calender rolls 12, and as indicated in FIG. 7, the stack 100 often includes many more than two rolls 12. In the preferred embodiment of the present invention, one caliper control apparatus **10*a*, which is configured for cooling, is installed adjacent a roll 12*c* that is heated by an internal fluid 104, such as steam, hot oil or by any other means commonly utilized in the art. A second caliper control apparatus 10*b*, configured for heating, is installed adjacent an unheated roll 12*b*, which in the embodiment of FIG. 7 is the drive roll. The heating apparatus 10*b*** is placed adjacent an unheated roll because the available temperature gradient with a heating system is highest when the system acts upon an unheated roll. On the other hand, the available temperature gradient with a cooling system is highest when the system acts upon a heated roll.

If none of the rolls 12 are heated, the cooling unit **10*a* would preferrably be installed at the top or "incoming" end 106 of the calender stack 100. It is at this incoming end 106 of the calender stack 100 that the higher temperature of the incoming sheet of paper 108 causes the sheet to display a greater tendency to substantially heat the rolls 12** which it contacts.

Figure 8:
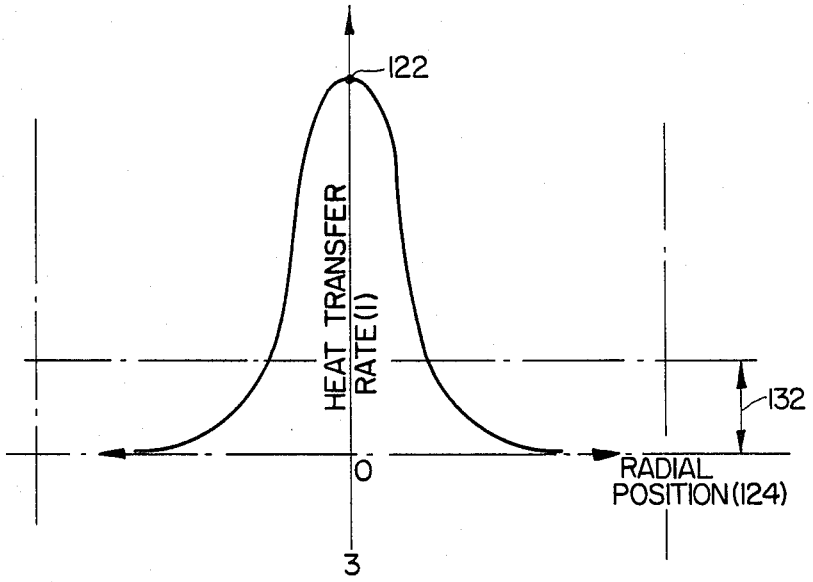
FIG. 8 PRIOR ART
FIG. 8 is a graphical representation of a typical heat-transfer profile over a heated or cooled surface, in response to single-jet impingement.
Figure 9:
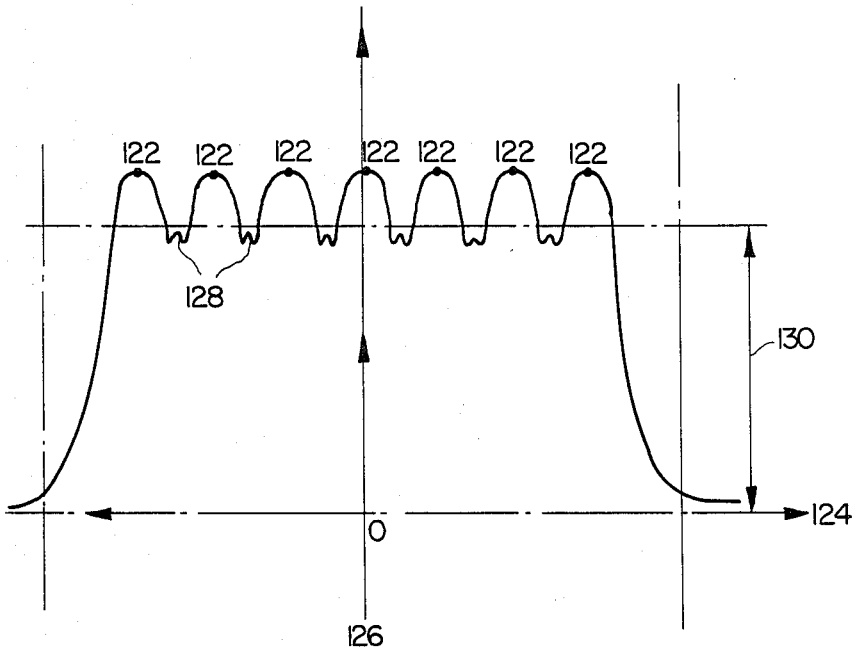
FIG. 9 is a graphical representation of a typical heat-transfer profile over a heated or cooled surface, in response to impingement by an array of jets, originating from an array of holes.

It is well known in the art of forced convection heat-transfer using non-volatile fluids that, in the majority of cases, impingement flow offers superior heat-transfer rates when compared to non-impingement flow methods. As a result, an impingement flow technique is employed in the present invention. As shown in FIG. 8, analysis of the heat-transfer profile about a single air-jet shows that the heat-transfer rate 120 is highest in the region of initial impingement 122. This rate is reduced radially 124 at an exponential rate from the central axis 126 outward. As shown in FIG. 9, when two adjacent nozzle jets are utilized, the stagnation of the spent flows of each in the region between the two jet axis, results in a secondary impingement "spike" 128 which effectively increases the average heat-transfer rate attributable to each individual nozzle jet. The effective heat-transfer rate of a given jet is also proportional to both the jet exit velocity (at close nozzle-to-surface gaps) and the jet exit diameter in such a way that the efficiency of a small jet is generally higher than that of a large jet. An array of small jets is therefore utilized in the present invention to achieve an effective heat-transfer rate 130 (over the area of the roll bounded by the respective nozzle) that is generally higher than the heat transfer rate 132 for a single-jet utilizing a similar fluid supply-pressure, jet exit-velocity, and volumetric flow-rate of fluid.

As shown in 1 and 2, the plate 34 extends the full width 16 of the apparatus 10 and is installed in cross-machine sections 35. The width of sections 35 are selected to facilitate fabrication of the sections 35. Each nozzle section 35 includes a pattern of nozzle holes 32 which is duplicated for each nozzle section 35.

Figure 10:
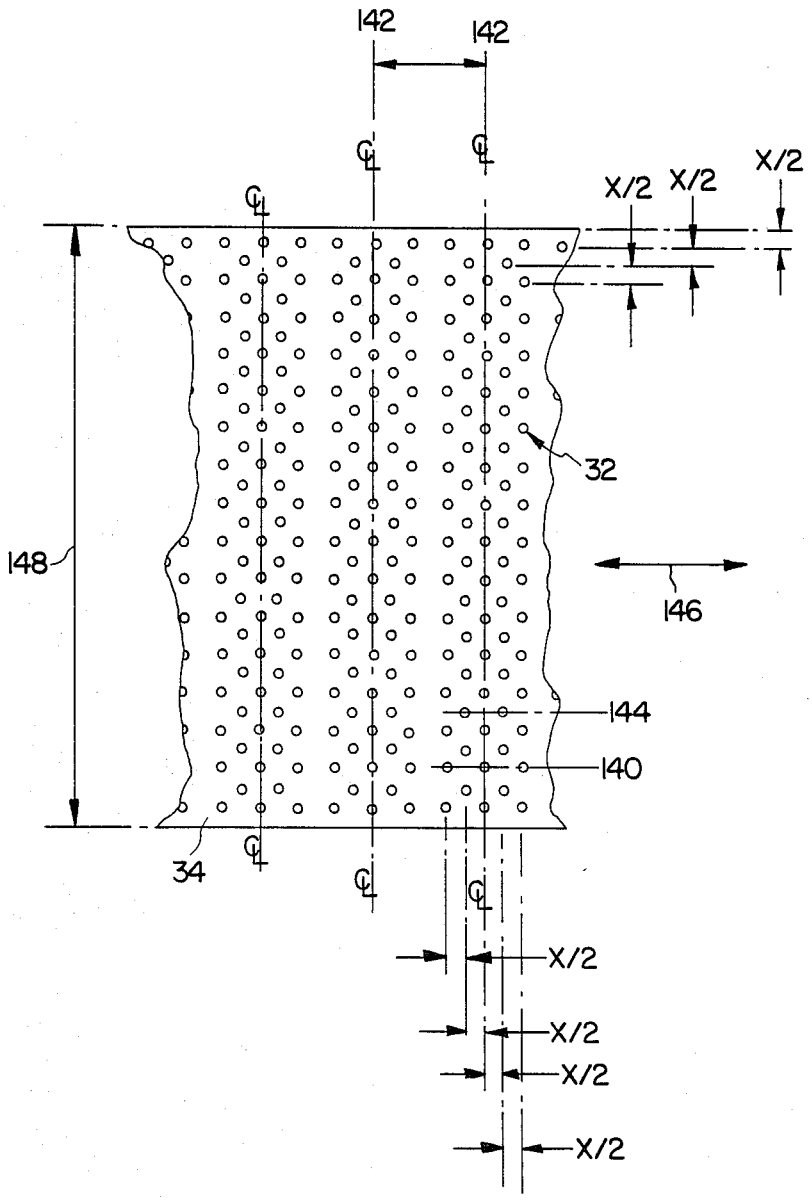
FIG. 10 is a front plan view of three adjacent nozzle plates, showing the preferred nozzle design.

Referring to FIG. 10, the hole pattern of a preferred embodiment comprises N vertically arranged rows 140 of three holes spaced x inches apart in the cross-machine direction 146, centered about the centerline 142 of the specific nozzle, and N-1 vertically arranged rows 144 of two holes spaced x inches apart in the cross-machine direction, centered about the centerline 142 of the specific nozzle. The two hole rows 144 being offset x/2 inches in the vertical and horizontal directions from the three hole rows 140. The vertical height 148 of the heat-transfer plate 34 being N inches, with the plate wrapping a portion of the circumference of the calender roll being W inches, $$\text{where } W = \frac{N * D}{D + (2 \times G)}$$

where

D = the diameter of the calender roll, and

G = the gap dimension between the plate surface 34 and the roll surface 58.

In an example of the present invention, the following exact dimensions are employed: N = 16 inches; x = 1 inch. The dimension of each individual hole 150 diameter is 1/16 inch.

The hole pattern described above is duplicated for every nozzle location 20, the nozzles being spaced 3 inches apart (from centerline 142 to centerline 142). In this example, the gap between the plate surface 34 and the roll surface 58 is no less than ¼ inch and no more than ½ inch.

The above-described non-limiting example provides an optimized hole pattern which enables the achievement of a satisfactory average convective heat-transfer coeffecient over the area of the roll bounded by the heat-transfer plate 34 of any nozzle location 20, so as to insure an adequate magnitude of heat-transfer to or from the roll. This example also provides a hole diameter and pattern which is practically fabricated. Finally, the selected hole diameter and number of holes enables the supplying of a practical magnitude of supply-air pressure and volumetric flow-rate to obtain the desired heat-transfer rate to or from the roll. The total flow-rate of air generally required is in the range of 10 to 30 standard cubic feet of air per minute per nozzle location 20.

While the foregoing invention has been described with reference to its preferred embodiments, various alterations and modifications will occur to those skilled in the art. All such alterations and modifications are intended to fall within the scope of the appended claims.

What is claimed is:

1. A caliper control system for selectively changing the caliper of a web passing between rolls of a calender stack, said system comprising:

first means for applying a heat transfer fluid to a surface of a first roll in the calender stack, said first means comprising a first distribution chamber for housing a supply of said heat transfer fluid, a first nozzle means for receiving said heat transfer fluid from said first distribution chamber and for applying said received heat transfer fluid to the surface of said first roll, said first nozzle means comprising a plate positioned adjacent said first roll, said plate including a plurality of sections and a pattern of holes comprising vertically arranged horizontal rows of three holes and vertically arranged horizontal rows of two holes positioned alternatively, each of said rows being centered about a vertical centerline of each nozzle plate section which enables said heat transfer fluid to pass through said plate to said first roll, and a first nozzle control means for regulating the flow of said heat transfer fluid from said first distribution chamber to said first nozzle means, said first nozzle control means being operable between a position allowing full flow of a said heat transfer fluid to a position preventing flow of said heat transfer fluid;

a second means for applying a heat transfer to the surface of a second roll of the calender stack, said second means including a second distribution chamber for housing a supply of said heat transfer fluid, a second nozzle means for receiving said heat transfer fluid from said second distribution chamber and for applying said received heat transfer fluid to the surface of said second roll, said second nozzle means comprising a plate positioned adjacent said second roll, said plate including a plurality of sections and a pattern of holes comprising vertically arranged horizontal rows of three holes and vertically arranged horizontal rows of two holes positioned alternately, each of said rows being centered about a vertical centerline which enables said heat transfer fluid to pass through said plate to said second roll, and a second nozzle control means for regulating the flow of said heat transfer fluid from said second distribution chamber to said second nozzle means, said second nozzle control means being operable between a position allowing full flow of said heat transfer fluid to a position preventing flow of said heat transfer fluid; and first means for controlling the temperature of said first roll of the calender stack prior to applying said heat transfer fluid by said first means for applying a heat transfer fluid.

2. The caliper control system of claim 1 wherein said first means for controlling the temperature of said first roll maintains said first roll in a heated state and said first means for applying a heat transfer fluid applies a cooled fluid to a surface of said first roll, said cooled fluid having a temperature less than the temperature of said heated roll.

3. The caliper control system of claim 2 wherein said second roll is in an unheated state and said second means for applying a heat transfer fluid applies a heated fluid to a surface of said second roll, said heated fluid having a temperature greater than the temperature of said unheated roll.

4. The caliper control system of claim 1 wherein said first means for applying a heat transfer fluid to a surface of a first roll further comprises a first means for selectively applying said heat transfer fluid to a local region of said first roll, and wherein said second means for applying a heat transfer fluid to a surface of a second roll further comprises a second means for selectively apply said heat transfer fluid to a local region of said second roll.

5. The caliper control system of claim 3 wherein said heated fluid is heated by steam.

6. The caliper control system of claim 2 wherein said cooled fluid is cooled by a cold liquid.

7. The caliper control system of claim 1 wherein said first means for applying a heat transfer fluid comprises a first plurality of said first nozzle means spaced across the width of said first roll, said first nozzle means having a first associated nozzle control means, and wherein said second means for applying a heat transfer fluid comprises a second plurality of said second nozzle means spaced across the width of said second roll, said second nozzle means having a second associated nozzle control means, each of said first and second associated nozzle control means being capable of having a common master control.

8. The caliper control system of claim 7 wherein said first plurality of nozzle means and said first associated nozzle control means are housed in a first common housing, said first common housing also including said distribution chamber which extends the width of said first roll and supplies all of said first plurality of nozzle means with heat transfer fluid, and wherein said second plurality of nozzle means and said second associated nozzle control means are housed in a second common housing, said second common housing also including said distribution chamber which extends the width of said second roll and supplies all of said second plurality of nozzle means with heat transfer fluid.

9. A caliper control system for selectively changing the caliper of a web passing between rolls of a calender stack, said system comprising first means for applying a heat transfer fluid to a surface of a first roll of the calender stack;

second means for applying a heat transfer fluid to a surface of a second roll of the calender stack;

first means for controlling the temperature of said first roll by the calender stack prior to applying said heat transfer fluid by said first means for applying said heat transfer fluid wherein said heat transfer fluid of said first and second means for applying a heat transfer fluid is provided by a first heat exchanger for said first means for applying a heat transfer fluid and a second heat exchanger for said second means for applying a heat transfer fluid, each of said exchangers including means for utilizing a cold liquid or steam to cool or heat said heat transfer fluid of said first or second means for applying said heat transfer fluid.

10. The caliper control system of claim 9 wherein each of said heat exchangers comprise a plurality of internally finned tubes, said steam or cold fluid being applied over an outer surface of said finned tubes to heat or cool the heat transfer fluid within said finned tubes.

11. A nozzle for use in a caliper control apparatus comprising:

a face plate having a front surface formed to match the surface to be heated or cooled, said face plate including a plurality of holes through said face plate, said holes arranged in a pattern of vertically arranged horizontal rows of three holes and vertically arranged horizontal rows of two holes positioned alternately, each of said rows being centered along a vertical center line of said face plate, said holes leading from a rear surface of said face plate to said front surface;

means for controlling the flow of a heat transfer fluid into a nozzle chamber located adjacent the face plate, said control means being operable between a position allowing a full flow of said heat transfer fluid and a position preventing flow of said heat transfer fluid to said nozzle chamber;

whereby after said heat transfer fluid flows into said nozzle chamber, the fluid exits said nozzle chamber through said plurality of holes.

* * * * *